US005948242A

United States Patent [19]

Ohsol et al.

[11] Patent Number: 5,948,242

[45] Date of Patent: Sep. 7, 1999

[54] PROCESS FOR UPGRADING HEAVY CRUDE OIL PRODUCTION

[75] Inventors: Ernest O. Ohsol, Crosby; John W. Pinkerton; Thomas E. Gillespie, both of Houston; Thomas H. Laity, Nassau Bay, all of Tex.

[73] Assignee: UniPure Corporation, Houston, Tex.

[21] Appl. No.: 08/950,482

[22] Filed: Oct. 15, 1997

[51] Int. Cl.[6] ..... C10M 175/00; C10M 33/00; C10M 33/04

[52] U.S. Cl. ..... 208/181; 208/179; 208/187; 208/188

[58] Field of Search ..... 208/187, 188, 208/181, 179; 210/707

[56] References Cited

U.S. PATENT DOCUMENTS

| | | | |
|---|---|---|---|
| 3,159,571 | 12/1964 | Reman et al. | 208/251 |
| 4,514,283 | 4/1985 | Closmann et al. | 208/86 |
| 4,634,520 | 1/1987 | Angelov et al. | 208/309 |
| 4,812,225 | 3/1989 | Corti et al. | 208/13 |
| 4,875,998 | 10/1989 | Rendall | 208/390 |
| 4,904,345 | 2/1990 | McCants | 196/46.1 |
| 4,915,819 | 4/1990 | Chirinos et al. | 208/309 |
| 4,938,876 | 7/1990 | Ohsol | 210/707 |
| 5,178,750 | 1/1993 | Mead | 208/309 |

FOREIGN PATENT DOCUMENTS

| | | |
|---|---|---|
| 634 641 | 1/1964 | Belgium . |
| 0103528 | 3/1984 | European Pat. Off. . |
| 0134088 | 3/1985 | European Pat. Off. . |
| 4208182 A1 | 9/1993 | Germany . |

OTHER PUBLICATIONS

Chung et al "Supercritical Fluid Extraction Reveals Resid Properties"; *Oil & Gas Journal,* Jan. 20, 1997; pp. 66–69.

*Primary Examiner*—Walter D. Griffin
*Assistant Examiner*—Tam M. Nguyen
*Attorney, Agent, or Firm*—Jenkens & Gilchrist, PC

[57] ABSTRACT

A process for upgrading heavy crude oil production is described which involves adding a diluent, or solvent, which is a light hydrocarbon to reduce the viscosity and specific gravity of the crude oil being processed. After dilution, the emulsions in the crude are broken and the separation of the crude into the components follows, aided by a second injection of diluent. This upgrades the crude and enhances the amount recovered for processing at a refinery. A high asphalt content of a heavy crude can also be tolerated in the practice of this invention resulting in environmentally-benign solids and water exiting a process which due to the modularization of equipment can be practiced at the well-head itself.

21 Claims, 3 Drawing Sheets

PROCESS FOR UPGRADING HEAVY CRUDE OIL PRODUCTION

FIELD OF THE INVENTION

This invention relates to an improvement in extraction of usable crude oil from heavy crude oil production. This improvement may be practiced at the well-head in the production area as well as at the refinery.

BACKGROUND OF THE INVENTION

In the processing of crude oils prior to refinery separations, the presence of intractable emulsions often presents serious problems leading to oil losses, contamination problems, corrosion, fouling or plugging problems, and expensive environmental treatment/disposal costs. These emulsions often arise while producing the crude from its formation source, especially when the crude is a heavy crude having an API gravity of about 20 or less, and particularly those with an API gravity from 7 to 12. These crudes are specially hard to produce, and when produced are difficult to refine. Many produced crude oils also contain soluble inorganic salts, such as sodium chloride, calcium chloride, magnesium chloride or sulfate. The presence of such salts in a crude oil wreaks havoc to the processing of the oil in a refinery, causing severe corrosion, poor cracking yields, plugging and ultimately equipment failure. It is customary to "desalt" incoming crudes at a refinery by mixing the crude with wash water and allowing the water phase to dissolve out the salt and settle in a desalter vessel. These vessels are often arranged in series for multi-stage desalting. Electrical grids are usually provided in the settled oil layer to encourage and accelerate coalescence of the residual water droplets. Recent analysis work on heavy Canadian and Chinese crudes illustrates problems inherent with refining heavy crudes. An article in *Oil & Gas Journal*, Jan. 20, 1997, describes the composition of two somewhat typical heavy crude oils in great abundance, but did nothing to suggest the recovery and processing. One of the problems especially in the case of heavy crude oils involves contamination by heavy metals and undesirable organic compounds of oxygen, sulfur and nitrogen. These materials are usually intimately associated with the organic interfacial structures of emulsions, thus exacerbating the intractability of the emulsion and also causing corrosion and undesirable contamination in refinery processes.

Often obnoxious, hard to handle, heavy crude oil in many parts of the world is, therefore, deemed uneconomic to produce and refine. Thus, there is a need for oil emulsion breaking/separation technology suitable for use adjacent to heavy crude oil producing fields where the heavy crude oil exits from the producing well combined with considerable water and solids. This is particularly the case when high pressure steam or other media particularly surfactant solutions are injected into the producing formation for enhanced recovery of high density, high viscosity crude oils. The crude oil-water mixture flowing to the surface generally contains a considerable, even a large, portion of a difficult-to-separate emulsions of water-in-oil, or oil-in-water. Some of the waxes and bitumen present with the oil in the underground formation, as well as finely divided inorganic solids such as sands or clays which act as emulsion stabilizers, providing a shield at the oil-water interface which prevents the water droplets from coalescing. These intractable emulsions are a serious disposal problem and represent a great economic waste. While U.S. Pat. No. 4,938,876 describes a very successful and useful system for emulsion breaking in a refinery operation, these lightly viscous, high specific gravity crudes defy successful enhanced gravity separation for meaningful oil recovery.

In the processing of heavy crude oils as produced from their formations, it is increasingly common to encounter crudes with a large component of asphaltic or resinous material. Such crudes are particularly difficult to process due to high viscosity, high specific gravity and high contents of heavy metals and sulfur. In the prior art where high quality lubricating oils are produced from refined heavy-oil fractions, asphalt and resins are removed during the refining process by dissolving the whole fraction in a low-boiling solvent such as propane or butane and then heating the solution under pressure to a point approaching the critical temperature of the solvent at which the solvent power decreases, and the least desirable fractions of the oil are precipitated—namely the asphaltic and/or resinous components. This is satisfactory in the refinery environment but has heretofore not been attempted with a messy heavy crude oil.

Additionally, heavy crudes in many parts of the world characteristically are high in asphaltenes content making them difficult to use as a refinery feedstock. In many parts of the world, early production of heavy-asphalt containing crude oils were merely stripped of their lighter, more easily refined, fractions at the well-head with the environment bearing the brunt of the disposal of the unwanted heavy fractions. Further, other sources of crude oil which are difficultly produced are the tar sands found predominantly in Canada, where the solid materials are difficult to separate from the refinable crude and when separation is possible, create a significant disposal problem because of continuing contamination by the solids disposed.

It is accordingly an object of this invention to provide a process for treating these heavy crude oils to recover more refinable product and provide for environmentally-benign disposal of less-useful materials.

It is a further object of this invention to provide a process for pre-treating produced heavy crude oils to remove asphaltenes from the crude prior to entering the refinery process. It is yet a further object of this invention to provide a process for separating solid materials contaminating heavy crude oil as produced whereby the separated solids may be disposed of in an environmentally benign manner.

It is yet a further object of this invention to provide a process for breaking intractable emulsions occurring in produced crude such that a greater amount of refinable oil is recovered and entered into the refining process. It is an especially preferred objective of this invention to provide such process and system which can be located at the well-head on a pad or skid-mounted support such that unwanted materials can be separated from refinable crude prior to the transportation of such material to the refinery.

The foregoing and other advantageous objects of this invention may be accomplished by the invention as herein described.

SUMMARY OF THE INVENTION

In the practice of this invention a light hydrocarbon diluent is added to the crude mixture for the purpose of lowering its viscosity and specific gravity. This diluent, in which the crude oil is soluble, results in an oil phase within the emulsion that is of a lower specific gravity than water which is needed to facilitate subsequent gravity-based separation of oil phase from water phase, thus making it possible to render the crude oil more easily refined. It also makes it less likely that emulsion could reform. The chosen diluent has a low boiling point, thus facilitating its eventual recovery from the produced crude oil, making it available for recycle to the separation process for reuse.

The low-boiling diluent, or solvent, could be a lower alkyl hydrocarbon such as C3 through C6 hydrocarbons, naphthas, aromatic distillate, aromatics such as benzene and toluene and in the field at the well-head, condensed casing-head gasoline could serve as the diluent, or solvent, or mixture of the foregoing. The amount to be added is an amount sufficient to accomplish the purpose for which it is added. As stated above, an important purpose is to reduce the specific gravity of the oil phase sufficiently below that of water so that enhanced gravity separation technique can be employed to separate the phases during the process or to reduce viscosity of the crude to ease pumping and enhance performance of separation equipment. It also facilitates the precipitation of the asphaltic, asphaltenic or resinous materials from the balance of the crude oil. With some asphaltenic crude oils it may be required to use from about one to about eight volumes of the light hydrocarbon solvent per volume of crude being treated. Since substantially all of the solvent/diluent is recovered during the processing, even prior to sending the crude to a refinery, the amounts added are not critical since they are recoverable and reusable for this purpose. However, an overly large excess of the diluent could adversely impact capital expenditure because of the volume which must be moved through the system. In the separation of the phases, the viscosity is used to judge the amount of light hydrocarbon added since the target viscosity is less than about 50 cp with less than 10 cp being preferred since that is an effective viscosity level. It is especially preferred that the viscosity of the crude and solvent mixture be from about 1 to about 5 cp. It has been determined that from about 5 percent to about 35 percent by volume is satisfactory for the purpose, preferably from about 10 percent to about 20 percent. It should be remembered that the diluent and the crude oil are, at normal conditions, cosolvents for each other thus giving a dual benefit. Those solvents with these characteristics are to be considered as a part of this invention. The diluted mixture of the crude oil/emulsion and diluent is heated and pressurized and then subjected to a flashing step to vaporize at least 5 percent by volume of the mixture to thereby break the emulsion into its components. It is preferred also to add diluent a second time after the emulsion breaking flash step to further enhance the oil recovery and separation from solids and salts. Said another way, it creates a better quality crude to sell to the refinery.

DETAILED DESCRIPTION OF THE INVENTION

Figure 1:
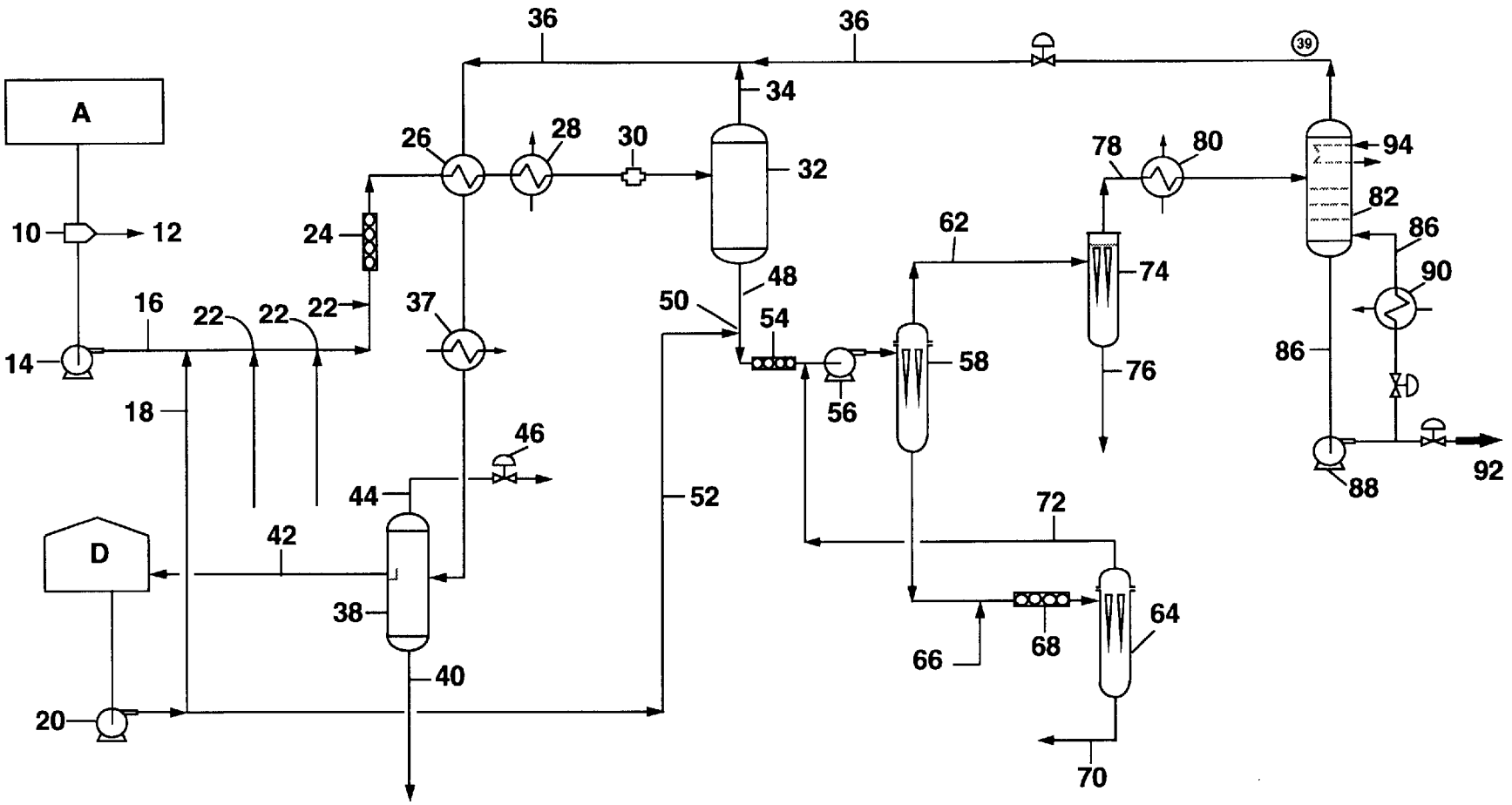
FIG. 1 is a flow diagram for an embodiment of the process for breaking the emulsion and separation of heavy crude oil.

This process is useful for recovery of useful crude oil from solids, such as sand or coke or semisolids such as asphalt. It is a flexible process which may be used, by those skilled in the art, to upgrade many different heavy crudes.

A combination process includes steps for the complete processing of a raw heavy crude oil which may include many, but not necessarily all, of the steps described below. Crude oils, especially the heavy crudes, vary widely in characteristics, composition and properties. Many variations in treatment will be evident from the following description of treatments for upgrading heavy crude oil. Those skilled in the art will see many useful variations of the practice of this invention. Many of these steps are well-known.

Coarse heavy solids are first removed from the raw crude by passing through a screen of suitable dimensions. The screening device would be arranged as a duplex system, one screen on-stream alternatively while the other is by passed and cleaned. This step removes large solids like rocks and other larger organic and inorganic solids.

The screened crude oil along with certain volumes of water and solvent as described below are blended in an agitated holding tank to insure uniformity of subsequent processing.

The screened crude oil is blended with an amount of relatively salt-free water sufficient to dissolve any inorganic salts contained in the crude oil. This could be in the vicinity of 1 to 10 volume percent on the crude.

The oil-water mixture is pumped to a sufficiently high pressure to feed the oil through a flash system as described in U.S. Pat. No. 4,938,876, which is incorporated herein by reference for all purposes. The pressure may be in the range of 50 to 250 psig or in some cases even higher. Again, it depends upon the crude oil being processed. The crude is normally analyzed anyway so based upon the analysis an engineer of ordinary skill could reach parameters of treatment.

Suitable emulsion-breaking chemicals are added as needed to the pressurized oil stream, in amounts in the range of 100 to 2000 ppm by volume, depending on the nature of the emulsion. They may be surfactants, chelating agents, or neutralizers as also described in the mentioned patent. Suitable chemicals are well-known and are readily obtained from Petrolite, BetzDearborn, Nalco or other suppliers. The additives may include anionic, cationic, nonionic and polymeric additives. Polymeric additives are used in relatively small dosages to encourage coagulation of extremely fine solid contaminants.

The emulsions encountered in this process will be broken by the thermal flash step, but due to agitation in following steps there may be a tendency to reestablish emulsions. When the emulsions encountered are of the oil-in-water type, it is desirable to add a surfactant favoring water-in-oil emulsions. Conversely, if the emulsions expected are of the water-in-oil type, a surfactant favoring oil-in-water emulsion should be used. Only small quantities of these counter-emulsifiers should be necessary, in fact, over dosing can be counter productive.

Some undesirable heavy-metal (such as vanadium, nickel, zinc, manganese and iron) contamination of crude oils will be include in the solids removed during separation, but often some will remain in the oil after separation. Using a powerful chelating agent, such as ethylene diamine tetracetic acid (EDTA) or its partial salts in the water phase, the heavy metals are attracted into the water-soluble chelating agent.

Free acid contamination from naphthenic acids, mercaptans or phenols which cause corrosion and product degradation can be substantially removed by injecting stoichiometric amounts of neutralizing agents into the crude mixture. Typical neutralizers could be sodium hydroxide, sodium carbonate, sodium borate, or ammonia. The neutralized acids will pass into the water phase.

In the practice of this invention, the screened, and chemically treated, if necessary, crude oil is preferably blended with a low-viscosity solvent to decrease the viscosity, and specific gravity, of the crude oil so that the components can be further separated by enhanced-gravity settling means (such as hydrocyclones or "hydroclones"). The solvent may be a light $C_4$ to $C_7$ hydrocarbon such as butane, pentane or toluene, and may be added in an amount of from about 5 to about 50 percent by volume based upon the oil in the crude mixture, preferably from about 10 to about 35 percent by volume. In most cases such a solvent will be recovered in subsequent processing and recycled.

The pressurized crude mixture is heated to a temperature well above the boiling point of its lighter components, for example, between about 200° F. and 400° F., using suitable heat exchange equipment. Heating can be staged so that the heat content of recycled condensing vapors can be first used, followed by trim heating in a heat exchanger using a separate heating medium. Alternatively, heating may be accomplished by direct injection of a relatively small amount of steam, still maintaining the system in fluid phase. Since water must be removed in the process, steam addition should be considered when the water gives some benefit to the overall process, such as improved slurrying during solids removal or to remove inorganic salts from the crude.

The hot, pressurized stream of crude and its additives is now passed through a flash controller in which the pressure is released to induce flashing of the stream to the extent that preferably 2 to 15 percent of the crude oil/water/solvent blend vaporizes on its way into a flash vessel, or vapor-liquid separator. This flashing step causes water-oil emulsions to be broken into their separate components as described in U.S. Pat. No. 4,938,876, incorporated herein by reference for all purposes, with light ends passing out overhead to a condenser and run-down tank. The condensed vapors will yield a water layer and a hydrocarbon layer above it. Both of these layers may be recycled or removed from the system.

Most of the crude stream and the diluent, or solvent, remains unvaporized and, the emulsion is now broken so the components can be separated by mechanical means such as by passing it through one or more hydrocyclone separators in series. Heavy components pass downward to the smaller diameter end of the device while the lighter components pass to the center and axially out of the larger diameter end. Alternatively, the crude bottom stream from the flash tank may be passed into a continuous centrifuge. The hydrocyclone system may be arranged in two stages, solids being removed in the first stage and water in the second. The solids from the first stage will contain some liquid contaminants and these may be removed by washing the solids in a continuous centrifuge using a detergent-containing water wash, and returning the washings to the beginning of the system. The clean solids may then be safely disposed, as an additive for cement manufacture, as a solid fuel, or for land fill.

The water separated in the second stage hydroclone will contain any soluble salts obtained from the crude oil, and may be discarded as a brine to conventional brine treating facilities.

Any dissolved gases entering with the original crude oil will be released in the flashing step and should be vented off the condenser run-down tank, using a pressure control valve. Suitable off-gas handling process equipment will depend upon the gas content.

This physical separation of the components and recovery of crude oil from the separated components is enhanced by a second injection of the diluent, or solvent, into the crude oil. This second addition will further reduce the specific gravity of the oil relative to that of the water, making the separation easier and more complete. Again, the amount of diluent added is determined by the oil content of the crude stream with an additional amount of from about 5 to about 20 percent by volume, preferably from about 7 to about 15 percent being added in this second diluent injection. This amount is included in the upper percentage mentioned previously.

If the crude oil stream, treated as described above has a high content of asphalts, asphaltenes, resins and the like, including some high boiling sulfur compounds and heavy metals chelated within some of the asphalts or resins it receives another dose of the light hydrocarbon solvent. To reject these contaminants after the initial flashing step, the crude oil is pressurized to a pressure of from about 50 to 500 psig. A suitable hydrocarbon solvent as described above, but preferably propane, butane, isobutar pentane, or hexane is added to dissolve essentially all the crude at temperature of from about 100° to 200° F. to obtain a single phase oil-solvent solution. The amount of diluent involved in this second addition step will be in an amount from 2 to about 8, preferably 2 to 5 times the amount of crude oil in the stream. Preferably the least amount necessary to dissolve substantially all the oil should be used to reduce operating cost and equipment size. The solvent will act only as a partial solvent at temperatures approaching the critical temperature of the solvent. Depending upon the particular solvent chosen, the critical temperature may be between about 220° and 500° F. Solvent mixtures, as stated previously, may be used so that a convenient temperature may be chosen by simple experimentation. In the embodiment where the process is practiced in the field at the well-head, casing-head gasoline or liquid natural gas may be used as the solvent in addition to those mentioned above. The pressure on the liquid must be maintained above, but substantially at, the critical to achieve the proper selected solvency of the crude.

The solution is heated under pressure to a temperature within from about 5° F. to about 25° F. below the critical temperature at which the desired fraction of the crude is precipitated. This precipitated fraction may be from about 10 to about 35 percent by volume, depending on the composition of the crude oil. The quality of the remaining crude (the "extract") will be higher, the greater the portion which is precipitated (the "raffinate"). The value of the raffinate will be lower, usually passing into a low value liquid fuel or raw material for conversion to gas or for asphalt or construction material. The raffinate may be used in the field as fuel to provide heat needed to run the process or other well facilities. The extract crude, even after solvent recovery, will be transportable via pipeline and/or tanker and significantly more valuable to a broader range of refineries.

The dissolving and precipitating action can be advantageously carried out in a counter current flow system, with the crude oil and solvent solution entering near the cooler end of the contacting equipment, and the lean solvent also entering at the cooler end. The ratio of solvent to crude oil stream, mentioned above, is controlled by the flow rates to the solvent extraction column for continuous operation. The crude-rich solvent leaves at the warm end of the domain, with heat being supplied near the discharge end. The heating of the rich solvent decreases the solubility of the heavier components of the crude and causes such components to be precipitated and to flow back toward the cooler end of the domain. This process can conveniently be carried out in a baffled vertical column, with rich solvent leaving at the top and lean solvent entering at the bottom, while crude enters at the lower third. The raffinate exits the bottom of the column.

After the solvent extraction/precipitation process there will be two exiting streams—a solvent stream loaded with crude oil with from about 2 to about 8 volumes of solvent per volume of dissolved crude and an extracted crude residue containing from about 5 to about 50 volume percent solvent. The solvent is stripped from the desired crude extract, preferably by conventional steam stripping or by a phase separation around the critical temperature. The recovered solvent is recycled. Unrecovered solvent could become part of the value of the crude. Preferably, both solvent introductions would use the same solvent, but different solvents can be used but would become mixed during the recycle step.

The raffinate from the solvent extraction will be a heavy liquid which can be steam stripped to remove substantially all the solvent for recycle. The stripped residue can be passed on to further processing as indicated above. If there is a substantial heavy metal content in this residue, it may be removed by countercurrent extraction with water containing EDTA or nitrilotriacetic acid or phthalodinitrile.

The steps of steam stripping and solvent recovery are well known to engineers and can be designed and operated following the criteria for separating the asphaltene components of the crude.

The recovered solvent vapors from steam stripping will, of course, contain water which will separate upon condensation. This water may be recycled. The recovered crude oil extract is dry and clean. It has a lower specific gravity, a substantially reduced viscosity, a low sodium content, a low sediment content, a low carbon residue, a greatly reduced heavy metals content, and lower in sulfur content. This upgraded crude oil will have a much higher value than the original crude oil and is in condition for successful refining.

The foregoing invention will be more explicitly illustrated by the discussion of the following examples with the accompanying figures to better illustrate several embodiments of this invention. This invention is an improvement over that described in U.S. Pat. No. 4,938,876, incorporated herein by reference for all purposes, and is particularly advantageous in connection with the treatment of crude oil before it enters the refinery processing or even before going to the refinery. The crude oil can enter this operating process at the well-head as it comes out of the ground if desirable, or from storage tanks in the gathering system in the field, or as a pre-treatment at the refinery property itself. The process of this invention lends itself well to modularization and thus will be practiced using only the embodiments which are required for a particular crude involved and the result desired. As discussed above, the improvement involves adding a diluent, solvent, to the crude oil to reduce its viscosity and specific gravity prior to flashing and emulsion breaking. The diluent assists in a cleaner separation of the crude oil from the aqueous phases in the broken emulsion. A second diluent addition follows the emulsion breaking to further assist in recovering a maximum of the refinable material in the crude. When it is necessary to deal with asphaltenes in the crude, a greater amount of solvent is required in the second addition later in the process to dissolve the asphaltenes and then to later precipitate them free of the other contaminants in the treatment environment.

The hydrocarbon added would normally be selected from $C_4$ to $C_7$ hydrocarbons, toluene or other light aromatics, kerosene, aromatic distillates, or even casing-head gasoline collected at the well-head if that is where the upgrading process is practiced or mixtures thereof. Normally in the first addition of the selected hydrocarbon, diluent from about 10 to 50 percent by volume, based upon the crude oil feed, would be added either all at one time or divided into the two introduction points. This amount, preferably from 15 to 20 percent by volume, is added to reduce the viscosity to less than about 50 cp, preferably to 15 cp and most preferably from about 1 to about 5 cp viscosity such that the separation steps after flashing are more easily accomplished. In addition, the solvent serves to reduce the specific gravity of the oil phase again making it simpler to separate from the oil phase.

Additional diluent is added after the flash step to improve the recovery of other components of the crude-oil mixture in an environmentally-benign manner. The following discussions of three embodiments of this invention will serve to illustrate its principles to those skilled in the art and serves to illumine and not to constrict the vision of possible applications and variations of this invention.

EXAMPLE No. 1

The process of this invention can be more readily understood by virtue of this example, referring to FIG. 1. Heavy crude oil containing emulsions, which also may contain inorganic salts, is pumped from a source A through a simple screening device 10 to remove gross contaminants (stones, rocks, etc.) 12 by pump 14 through line 16. A light hydrocarbon diluent (such as light naphtha) is pumped from storage D in an amount of from 10 to 20 percent by volume based on contained oil by pump 20 and injected into line 16 at from line 18 into the crude emulsion stream leaving pump 14. Pumps 14 and 20 ensure that the mixed stream of crude and diluent will be at a desirable steady pressure of from about 100 to about 350 psig. The added light hydrocarbon lowers the viscosity of the mixture making the crude more easily pumped through the system and reduces the specific gravity of the oil phase to enhance separation after the emulsions are broken. Small amounts (about 100 to 1000 parts per million) of optional additives such as demulsifying chemicals, chelating agents and neutralizing agents are shown as injection streams 22. The crude-oil mixture is passed through in-line mixer 24 which serves to thoroughly blend the crude emulsion, the diluent and the additives, if any. A "KENICS" mixer is a typical device of this kind. The well-mixed stream now flows through heat exchanger 26 where it picks up heat from condensing vapors from flash drum 32 and stripper 82. The mixed stream passes through a trim-heater 28, where its temperature is brought up to a predetermined level, which may be closely set within range of from about 275° to about 400° F. The trim heater 28 is supplied with an independent source of heat, such as steam or hot oil for the trim heater 28. The now blended, heated and pressurized crude oil feed stream passes through flash controller 30 into flash drum 32 which releases the pressure a predetermined amount, causing a desired fraction of the feed material to rapidly vaporize, thus rupturing the emulsion. This flashing step to break emulsions is described in some detail in the referenced U.S. Pat. No. 4,938,876. Water and light hydrocarbon vapors in an amount of 5 to 20 percent of the feed are flashed and drawn off as vapors through line 34 enter line 36, supply heat in exchanger 26 and enter cooler 37, where they are condensed into liquid water and hydrocarbons, entering receiver 38. The water separates and is removed from the bottom of receiver 38 through line 40 while the lower density hydrocarbon phase is removed through line 42 and transferred to diluent storage D. A small amount of non-condensible gases is released from receiver 38 by line 44 through pressure control valve 46. This valve 46 controls the pressure in flash tank 38 and indirectly controls the liquid temperature therein. Normally, the temperature of the flash tank 32 is preferably held between about 210° and 260° F., with the pressure set at from about 5 to about 50 psig.

Alternatively, the pressure could be set at 2 to 10 psi absolute, and the temperature range would be 120° to about 200° F. when the vapors are condensed under a low pressure and the condensate pumped out or discharged through a barometric leg system.

The liquids and solids leaving the bottom of flash tank 32 through line 48 are joined by from about 10 to about 30 percent by volume based upon the oil content of the stream additional diluent injected at 50 from line 52 and after blending in mixer 54 are pumped via pump 56 into a hydroclone 58, Desander No. 1. A small stream of 5 to 20 weight percent solids in water leaves the high-specific gravity outlet at the smaller end of hydroclone 58 as stream 60, while the bulk of the fluid leaves at the larger, low gravity end of hydroclone 58, normally several hydroclones operating as a "bank" in parallel, through line 62. The solids slurry line 60 passes into a second hydroclone 64, desander No. 2, being mixed with wash liquid 66, usually water with some surfactant, using mixer 68, for washing residual oil from the rejected sand and other solids. The washed solids leave the second hydroclone 64 though line 70 for disposal or, alternatively, for use as fuel to make steam or for conversion to asphalt or coke. The washing from the second hydroclone 64 pass out through line 72 for recycle into the inlet to pump 56, constituting a relatively small fraction of the feed to hydroclone 58.

The overhead, as clear liquids, exits from hydroclone 58 through line 62, passes into a third hydroclone 74 which serves to dewater and desalt the crude oil, rejecting salty water as stream 76, and retaining the dry oil for discharge as the bulk stream leaving hydroclone 74 through line 78. This the oil in line 78 is reheated in heat exchanger 80 using an independent source of heat such as hot oil or vapors, and fed into a diluent stripper column 82 through a flash control valve 84. Part of the feed, mainly part of the low-boiling diluent, will flash into vapor as it enters the column, the rest passing downward over several trays to the bottom, where it is circulated through a line 86 pump 88 and heater 90, generating vapors to travel up the column 82 counter current to the liquid. The balance of the bottoms from the column 82, removed by line 86 is bled off in line 92 as the desired product, clean, dry salt-free oil which has enhanced value as a feed crude oil at a refinery.

The overhead from the stripper column 82 passes through internal condenser 94 to create a partial reflux in column 82 and exits through line 36 and joins the other diluent vapors from line 34 and then condenses in heat exchanger 26 and 37 for return to diluent storage D by receiver 38 and line 42. Vapors leaving the top of stripper column 82 are partially condensed by reflux cooler 94 to provide enough reflux above the column feed to ensure that the recycle diluent is not contaminated by higher boiling material from the crude. Ideally, the system is kept in balance so that no light ends are lost from the diluent into the heavy oil product.

As an alternative for treating the solids after washing, instead of a second hydroclone bank 64, a centrifuge such as a high-speed disc horizontal centrifuge such as supplied by Flottweg, Veronesi or Alfa Laval, can be used. This would have the advantage of a higher solids content in the discharge but would be somewhat more expensive.

EXAMPLE No. 2

Figure 2:
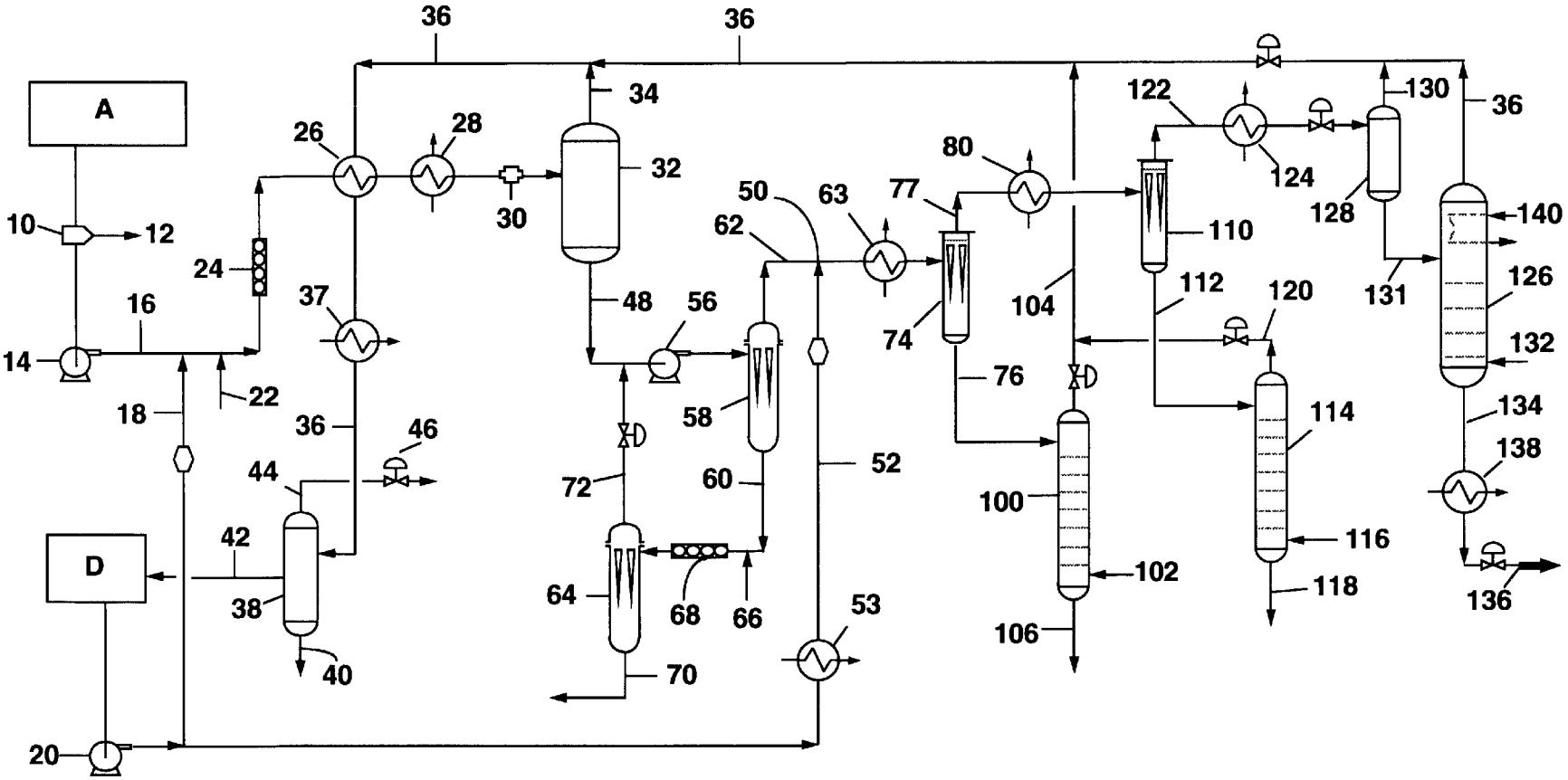
FIG. 2 is a flow diagram of a process for breaking the emulsion and upgrading a heavy crude oil.

This example describes upgrading a produced crude oil stream containing large amounts of solids in the form of asphalts. The operation of this process will readily be understood by reference to the following description of another preferred embodiment shown in FIG. 2. Contaminated crude oil (including emulsions) from source A flows through a set of screens 10 to remove gross contaminants such as stones, rocks and other foreign debris, which are removed through line 12 as described in Example 1. The screened crude oil is pumped by pump 14 at a pressure of 150 to 200 psig at the pump discharge through line 16. A suitable stream of diluent from supply tank D is metered into the crude oil stream at 18 from pump 20. The quantity continuously metered into the crude oil is from about 10 to about 50 percent by volume based on the oil content of the crude, delivered at a pressure slightly exceeding the crude oil line pressure. Just before or preferably just after the diluent addition, other additives, as needed, are metered into line 16 at 22—for example a demulsifier chemical (used in small quantities) and a neutralizer (such as 20% caustic soda solution or milk of lime or soda ash solution or aqueous ammonia). An effective chelating agent such as EDTA may also be added. Functions of these additives are well-known and have been previously described and are fully set forth in U.S. Pat. No. 4,938,876.

The crude oil and diluent mixture plus various additives are well blended as the mixture passes through mixer 24 and flows through heat exchangers 26 and 28, where the mixed stream is heated to a temperature of from about 250° to about 350° F. The exact temperature of the heating may be controlled through use of trim heater 28. The temperature provided by 28 is such that when the pressure is reduced at flash controller 30, approximately 10 percent of the contained liquid will flash into vapor. For example in flashing from a line pressure of 200 psig to a release pressure of 50 psig, vapors of some of the light ends as well as some of the water will release. This ensures that a portion of each droplet of dispersed phase in the contained emulsion will vaporize into a large volume, thus rupturing the emulsion. It is also possible and in some cases desirable to flash to a lower pressure such as about 5 psi absolute with the benefit of vaporizing certain undesirable components in the crude oil, such as benzene or the lower mercaptans. The vapors released in flash drum 32 pass out through vapor line 34 into line 36 through heat exchanger 26, where they are condensed into diluent liquid and water, providing some of the energy necessary to heat the entering oil-diluent mixture. Additional necessary cooling is provided by cooler 37. The condensed liquids (and any residual non-condensible gases) pass into decanter 38 from which water is drained at the bottom via line 40; recovered diluent is decanted through line 42, and non-condensible gases are released at the top through line 44, using pressure-control valve 46. The vent gases from line 44 are recovered or flared as required for environmental protection.

The crude oil mixture in flash drum 32 leaves by line 48, pump 56 and is sent to hydroclone 58, which separates a high density stream of solids slurried into a small amount of water and a lower density main stream of oil and dilue leaving overhead through line 62. The solids slurry leaves hydroclone 58 by line 60 and is further processed in a second, smaller hydroclone 64, receiving a small amount of detergent wash solution through line 66 passing through mixer 68 before it enters hydroclone 64. This detergent serves to wash any adhering oil from the solids as it passes through 64, so that the solids discharged through line 70 are a relatively clean slurry in water. The washings containing the last bit of oil leave hydroclone 64 overhead by line 72 for recycle.

The water in slurry line 70 and the water in stream 40 leaving at the receiver 38 are the main exits for water entering as injected steam (if used) or with the crude oil. The solids slurry leaving at line 70 may, if desired, be passed through a high-speed disc or horizontal centrifuge which will discharge almost dry solids and clear water. Alternatively, the slurry could be allowed to settle in a suitable tank. As an option, the dry solids could be burned when used in the field to provide heat to operate the process.

The main oil-diluent stream leaves hydroclone 58 through line 62 and is blended with a relatively large amount of additional diluent delivered from line 52 at 50 to combine with the overhead from hydroclone 58 in line 62. For temperature control, the diluent stream in line 52 may be cooled by cooler 53 as necessary. The volume of additional diluent solvent may be from about two to about four times the oil in the stream. This new blend (which may be mixed with another in-line mixer, if desired, is fed to temperature control device 63, where the mixture is carefully brought to a temperature within about 5° to about 25° F. of the critical temperature of the diluent. This will depend upon the exact composition of the blend, but probably will be in the range of 160–190 degrees Fahrenheit. After a short time, the least soluble heavy components of the crude oil will precipitate as solids or semi-solids and are separated in hydroclone 74, the solids leaving at 76, and the light-oil solution leaving through line 77. The solids and heavy oil is run into steam stripper 100, where it flows countercurrent to a stream of steam injected through line 102 rising through the stripper column 100 to its top outlet through line 104 containing vapors of the diluent and uncondensed steam. The bottoms of stripper 100 leave through line 106 and consist of essentially water-free liquid asphaltic material, which is preferentially high in carbon content and heavy metals. By proper selection of temperature in the heater 63 and choice of feed material, a relatively high grade saleable asphalt may be recovered through bottoms line 106.

The oil phase leaving hydroclone 74 overhead through line 77 is passed through another heater 80, which raises the temperature of the solution to a point where additional insoluble solids or semi-solids will precipitate. This material is separated in hydroclone 110 and will also be fairly high in carbon content and heavy-metal contaminants, but not as high as the asphalt exiting stripper 100 through line 106. In many cases the fraction of the crude recovered through lines 106 and 118 may total from about 15 to about 30 percent by volume of a heavy crude oil charged. Ideally, the total amount of solids material can be adjusted so that its fuel value does not exceed the fuel required to operate a heavy crude oil production facility (steam requirement, etc.), thus making the processing equipment self-sustaining in the field.

A pump may be provided in line 77 in case there is insufficient pressure in the feed stream 77 to properly operate hydroclone 110. In hydroclone 110, the precipitated resinous material is removed from bottom through line 112, fed to stripper 114 using steam entering at 116 as stripping agent, taking a diluent-free solid bottoms 118 and recovered diluent overhead stream in line 120 for recycle to line 36 and heat exchanger/condensers 26 and 37, and ultimately to storage D.

For use as fuels, the asphaltic and resinous materials in streams 76 and 112 may contain an unacceptable high content of heavy metals (such as nickel and vanadium). An optional additional step in which either or both of these streams is mixed with a suitable at about a 2 to 1 volume ratio of water containing a 2 to 5 percent concentration of a chelating agent such as, for example ethylene diamine tetracetic acid, EDTA, in solution as partial sodium salt. The mixture is well agitated for 2 to 20 minutes at a temperature in the range of 80 to 180° F., then separated in suitable separation equipment such as another hydroclone, from which the hydrocarbon phase is removed. The water phase containing a major portion of the heavy metals is sent to a water purification system for removal of the metals by known means. The hydrocarbons will then be even more suitable for use as fuels.

The deasphalted oil/solvent mixture leaving hydroclone 110 in line 122 passes to a final heater 124 which serves as a preheater for final solvent or diluent stripper 126. There is a small pre-flash drum 128 which serves to release some diluent vapor directly through line 130 before entering stripper 126 through line 131. The pre-flashed liquid now enters the stripper 126 through line 131, and contacts steam from steam inlet 132 counter currently on its way to bottom outlet line 134 and final finished crude oil storage 136, via a cooler 138, if desired, as a high quality heavy crude oil product ready for refining.

The vapors passing up the stripper are cooled somewhat in coil 140 to produce sufficient reflux to prevent loss of product with the vapors leaving the stripper 126 through line 36. The vapors in line 36, 130, 104 and 34 combine as recycle diluent in storage ID.

EXAMPLE No. 3

This example illustrates the practice of the invention on a crude-oil stream which contains large quantities of asphaltenes and salts.

Figure 3:
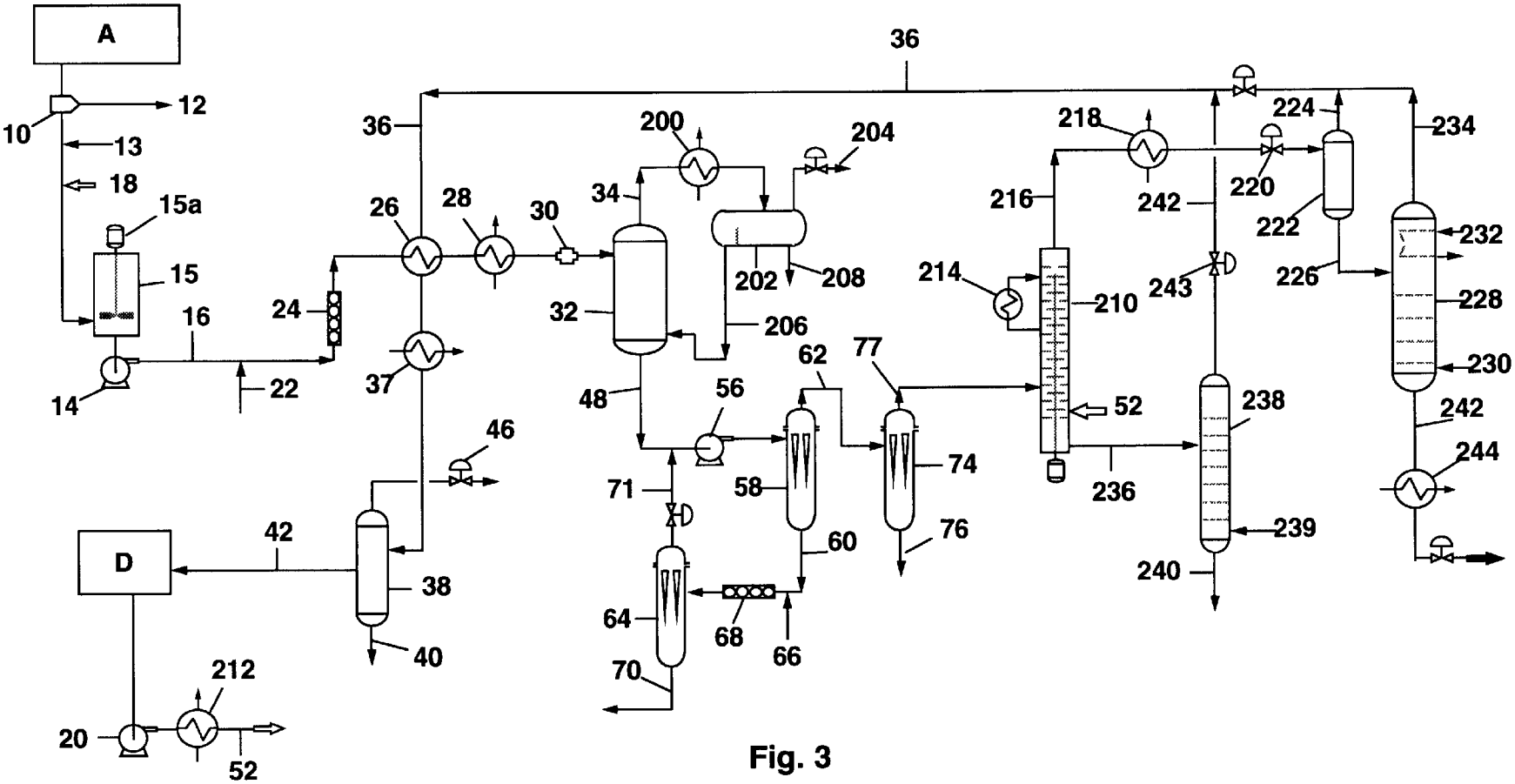
FIG. 3 is a flow diagram showing the combination of flash purification, solvent deasphalting, and the desalting of heavy crude oils using a preferred embodiment of the described invention. Here the second step of the solvent addition is to accomplish deasphalting of the crude.

Referring to FIG. 3, heavy crude oil enters the system from source A and is passed through a duplex strainer 10, which serves to remove large solids 12 which, would prove obstructive. From strainer 10 the crude oil is directed to blending tank 15 where from about 5 percent to about 35 percent, by volume based upon the crude, of cutting solvent 18 is mixed to reduce viscosity of the crude to facilitate handling. Preferably, from about 5 to about 10 volume percent a light naphtha is sufficient to reduce the viscosity to about 4 cp. Also a feed stream of 5 to 10 volume percent of substantially salt-free water is added 13 to provide solvent for inorganic salt removal from the crude oil. The oil and these additions are well blended by the action of mixed agitator 15*a* in tank 15. The blend is then pumped by pump 14 to a pressure of 150 to 200 psig through line 16. The screened and pressurized crude mixture may also have an addition of small amounts of acid neutralizers, emulsion breakers, and chelating agents as described in U.S. Pat. No. 4,938,876 added through line 22. They are optional, depending upon treating requirements of a given crude oil, as is well known by operating in the art, and are used as needed in only small quantities, such as 50 to 500 parts per million of oil. An in-line mixer 24 is provided to ensure thorough blending of these additives into the oil. The crude oil stream is then heated to a temperature of from about 300° to about 350° F. Heat may be provided in heat exchanger 26 and/or heat exchanger 28. Alternatively, heat can be provided by direct injection of live steam into the oil stream, using an injection nozzle. The heated and pressurized oil stream is now released through flash controller 30, which may be an adjustable Venturi nozzle, into flash drum 32 to a down-stream pressure of the order of 15 to 75 psig in such fashion that at least about 5 percent of the contained water and naphtha solvent flashes into vapor. This immediately breaks any emulsions where the dispersed phase contains the light end. In this particular example, the pressure is released to 50 psig. The overhead vapors leaving flash drum 32 via line 34 pass through watercooled or air-cooled condenser 200, where they are essentially all condensed into liquid hydrocarbons (including cutting solvent) and water, and run down into receiver 202, where the hydrocarbon and water phases immediately separate. Any non-condensed vapors (such as nitrogen, methane, hydrogen sulfide and carbon dioxide) are released through back-pressure control valve 204. The released gases are sent to suitable vapor recovery, scrubbing or incineration facilities.

The oil and water phases are separately decanted from receiver 202, the oil phase in line 206 being returned to the flash drum 32 and the water phase drained off line 208 for proper water purification treatment or alternatively, sent back to blending tank 15. The bulk of the initial feed material remains in the bottom of the flash drum 32 and passes as stream 48 by gravity into high pressure pump 56, which re-pressurizes the feed to a pressure in the range of 400 to 500 psig, sufficient to drive the feed through two hydroclones in series and provide the desired operating pressure for the following extraction device. The crude feed from pump 56 enters the first hydroclone 58 at its tangential inlet end and discharges rejected solids at the lower end as a concentrated slurry through line 60 while the desanded fluids exit overhead in line 62 and pass into the second hydroclone 74 for dewatering. The tailing from hydroclone 74 is a small stream of salty water, line 76, containing essentially all the salt which entered with the crude oil. The crude oil plus the small amount of cutting solvent leaves hydroclone 74 through line 77 and is now free of water, salt and solids.

The solids rejected in the first hydroclone 58 exit through line 60 can be washed free of oil and thus rendered a non-hazardous waste by adding water and detergent 66, mixing 68 and use of another desanding hydroclone 64, fed by the rejected solids/water slurry in line 60 with a small amount of detergent from line 66 blended in by mixer 68 and entering hydroclone 64 tangentially. The swirling action in hydroclone 64 scrubs the oily material away from the solids which can be discharged relatively clean through line 70 (suitable for final separation). The oily washings from hydroclone 64 can be recycled as a small overhead stream 71 into the suction of pump 56.

The main crude oil stream leaving hydroclone 74 through line 77 is fed at a steady rate to a countercurrent extractor 210, in this particular case a Rotating Disk Contactor (RDC) is shown. The crude oil is fed into the multi-stage extractor 210 at the top of the bottom third of the solvent extractor 210, while about 3 to 5 volumes (relative to the crude oil volumetric flow) of solvent is fed in at the bottom in line 52. The temperature of the solvent, a blend of normal butane and pentane exiting storage D into line 52, is raised in heater 212 to a temperature such that the solvent plus extracted crude oil will be at a temperature of from about 50° to 100° F. below the critical temperature of the solvent blend, in this case between about 250° and 300° F. The solvent containing extracted crude oil, passes upward through the contractor 210, counter current to a descending stream of heavier components. The rotating discs serve to ensure contact between the rising solvent and the descending droplets. The rotating discs propel the disperse phase outward while the doughnut-shaped baffles direct the droplets back toward the center of the column onto the discs in the lower compartments of the device. Thus each disc and doughnut pair constitute an extraction stage as is well known by the skilled engineer. Near the top of the column 210, a side stream of solvent phase is withdrawn and passes upward through a heat exchanger 214 to raise the solvent temperature about 20° F. and return it to the column. Steam can be used as a heating medium for exchanger 214. This temperature rise in the solvent causes previously extracted crude oil to become insoluble and provides a reflux stream of rejected disperse phase descending down the column. The percent of the crude oil precipitate can be accurately controlled by setting the temperature to which the solvent is raised in exchanger 214. In this example, about 20 percent of the crude oil is rejected as asphaltic material, leaving 80 percent dissolved in the solvent exiting the column 210 in line 216, which is now further heated in short contact time heater 218 to about 400° F., released in pressure at valve 220 to about 100 psig into pre-flash vessel 222, at which point a large fraction of the solvent is released as vapor into line 224. The liquid crude exits in line 226 and still contains solvent, and is fed to stripper column 228. Solvent is recovered from the crude oil by direct injection of stripping steam 230 at the bottom. Crude oil remaining in solvent vapor is refluxed by cooling at 232 (in this example using indirect water cooling). The vapors exit in line 234 and are combined with vapors in line 224 and 242 into line 36 through exchangers 26 and 37 to decanter 38 where water is removed through line 40 and solvent returns to tank D through line 42.

Asphaltic crude oil collected at the bottom of RDC 210 is withdrawn through line 236 and fed to solvent stripper 238 designed to operate at a fairly high temperature (about 300° F.) to maintain a reasonably low viscosity for the material to flow down the column. Stripping steam is injected through line 239 at the bottom, and released solvent vapors leave the top of the column through line 242 in which pressure control valve 243 is provided so that the depressurized vapors can join the other recovered solvent vapors in line 36. The vapors in 36 provide some heat for heat exchanger 26 and can then be condensed in watercooled condenser 37. Condensate runs down through line 36 into receiver 38, where a water layer will separate for withdrawal through line 40. This water may also be recycled as make-up water for blending tank 15. The recaptured solvent is decanted through line 42 and is returned to solvent storage vessel D. Any non-condensibles from receiver 38 are released through back pressure controller 46 to suitable vent recovery facilities (flare, scrubber, absorber, etc.).

The stripped asphaltic portion of the crude oil discharges from the bottom of solvent stripper 238 through line 240 for suitable further processing. This material may contain considerable quantities of absorbed heavy metals such as vanadium, nickel, copper, iron, and the like. These can be removed, if desired, by scrubbing this residual stream with an aqueous solution of a chelating agent such as EDTA. The residual hydrocarbons can be used as fuel, feed stock for paving or roofing asphalt manufacture, or conversion to synthetic fuel gas, etc.

The striped crude oil leaving column 228 via line 242 can be cooled if necessary via water cooled heat exchanger 244 and released via a pressure controller in line 242 as a high-quality crude oil for transportation and refining.

From the foregoing description and specific embodiments of this invention as described, those of ordinary skill in the art would readily recognize many variations of the practice of the invention set forth in the disclosure above and covered by the appended claims without departing from the scope and intention of such claims. Many variations are possible and operating conditions within the skill of the engineer will vary according to the different properties of the many varied heavy crude oil deposits being processed. With each crude oil properties and components can be determined by simple experimentation and based upon such analyses, the specific parameters and processing equipment can be determined and engineered. All of this can be done without departing from the intended scope of the appended claims.

We claim:

1. A process for upgrading heavy, high viscosity, crude oil produced as a crude oil/water emulsion comprising the steps of:

adding a sufficient amount of a light hydrocarbon diluent having a boiling point of from about 10° to about 180° F. to said crude oil/water emulsion to form a mixture having a viscosity of less than about 50 cp;

heating and pressurizing said mixture to suitable conditions for breaking said crude-oil/water emulsion contained in said mixture by flashing;

breaking the crude oil/water emulsion and forming a vapor effluent and a liquid effluent by flashing said mixture to a sufficiently low pressure to vaporize at least about 5 percent by volume of said mixture;

separating crude oil from said liquid effluent; and recovering said separated crude oil.

2. The process of claim 1 further comprising the step of removing gross solids from said crude oil/water emulsion prior to the flashing step and said separating step includes introducing a stream of additional hydrocarbon diluent to enhance the removal of asphaltic material from the crude oil.

3. The process of claim 1 wherein the amount of hydrocarbon diluent is from about 10 to about 35 percent by volume of the oil in the crude oil/water emulsion.

4. The process of claim 1 wherein the hydrocarbon diluent is selected from the group consisting of $C_3$ to $C_7$ paraffinic or naphthenic hydrocarbons $C_6$ to $C_8$ aromatic hydrocarbons, casinghead gas condensate, light aromatic distillate and mixtures thereof.

5. The process of claim 1 wherein the hydrocarbon diluent is a mixture of more than one light hydrocarbon boiling at a temperature of from about 10° to about 180° F.

6. A process for upgrading a heavy, high viscosity, crude oil/water emulsion containing water, solids, and impurities comprising heavy metals, asphaltic, asphaltenic and resinous materials, which process comprises the steps of:

removing gross solids from said crude-oil/water emulsion;

adding a light hydrocarbon diluent to the crude oil emulsion to form a mixture containing said crude-oil/water emulsion and said diluent;

pressurizing and heating said mixture;

flashing said heated mixture under such conditions to vaporize a sufficient amount of said mixture to break the crude oil emulsion and to form a vapor effluent containing said diluent, water, crude oil and some entrained solids and a liquid effluent containing said diluent, water, crude oil and solids;

separating said crude oil and asphaltic and alphaltene materials in said liquid effluent from water, solids and impurities, adding additional diluent to the liquid effluent after the flashing step, using 200 to 800 volume percent based on the separated oil content, selecting the diluent from the group of $C_4$ through $C_7$ paraffinic or naphthanic hydrocarbons at a moderate temperature of 60° to 100° F. to obtain a continuous single phase oil-diluent solution;

gently warming the oil-diluent solution to a temperature within about 5° F. to about 25° F. of the critical temperature of the diluent causing a substantial part of the asphaltic or asphaltenic content of the crude oil to precipitate, causing the asphaltic solid or semi-solid material to settle from the lighter oil-diluent solution;

separating the diluent from the oil for recycling; and recovering the crude oil product.

7. The process of claim 6 wherein said diluent is normal butane or isobutane.

8. The process of claim 6 wherein said diluent is pentane.

9. The process of claim 6 wherein said diluent is heptane.

10. The process of claim 6 wherein said diluent is a mixture of $C_3$–$C_5$ hydrocarbons.

11. The process of claim 6 wherein said diluent is a $C_5$–$C_6$–$C_7$ blend.

12. The process of claim 6 which includes the step of recovering the diluent in a plurality of stages, using progressively lower pressures and supplying heat to vaporize the diluent.

13. The process of claim 6 further comprising the steps of steam stripping the diluent from the oil, condensing the vapors and decanting the condensed water from the recovered diluent.

14. The process of claim 6 wherein said additional diluent is introduced in a continuous countercurrent contacting device, near an asphaltic removal end and diluent-oil solution is removed at an opposite end.

15. The process of claim 14 wherein a temperature gradient is maintained within said contacting device with a higher temperature at the diluent-oil discharge end by suitable heat transfer means.

16. The process of claim 14 wherein said contacting device is a Rotating Disc Contactor.

17. The process of claim 14 which includes the step of recovering diluent from the separated asphaltic material.

18. The process of claim 17 further comprising the step of subjecting the separated asphaltic material, while still containing some diluent to a countercurrent washing with water containing a chelating agent for removal of heavy metals from the asphaltic material.

19. The process of claim 18 in which the chelating agent is EDTA or one of its sodium salts.

20. The process of claim 18 in which the chelating agent is nitrilotrisacetic acid.

21. The process of claim 18 in which the chelating agent is a glycolic acid.

* * * * *